United States Patent [19]

Smrt

[11] 4,024,990

[45] May 24, 1977

[54] DISPENSING APPARATUS FOR AEROSOL SPRAY CANS

[76] Inventor: Thomas J. Smrt, 31W 300 W. Bartlett Road, Bartlett, Ill. 60103

[22] Filed: July 10, 1975

[21] Appl. No.: 594,623

[52] U.S. Cl. ..... 222/180; 222/505; 141/362; 425/100

[51] Int. Cl.[2] ..... B67D 5/08

[58] Field of Search ..... 222/70, 180, 325, 402.21, 222/505, 192; 141/360–362; 425/98, 100

[56] References Cited

UNITED STATES PATENTS

| | | | |
|---|---|---|---|
| 3,107,821 | 10/1963 | Lambert | 222/505 X |
| 3,187,948 | 6/1965 | Hunt | 222/180 X |
| 3,610,471 | 10/1971 | Werner | 222/70 |
| 3,633,651 | 1/1972 | Ruhlandt | 425/100 X |
| 3,677,441 | 7/1972 | Nixon, Jr. et al. | 222/70 X |

*Primary Examiner*—Drayton E. Hoffman
*Assistant Examiner*—Charles A. Marmor

[57] ABSTRACT

An apparatus for intermittently dispensing the contents of aerosol spray cans includes a pivotal actuator for opening and closing the valve of the aerosol can and a rotatable drive wheel for intermittently pivoting the actuator. The drive wheel carries a plurality of pins for pivoting the actuator as the wheel rotates, and the position of selected pins can be adjusted so that one or more pins do not engage the actuator. The wheel is rotated intermittently by an arm which reciprocates in a direction perpendicular to the axis of rotation and which engages one of the pins during each reciprocation.

14 Claims, 13 Drawing Figures

DISPENSING APPARATUS FOR AEROSOL SPRAY CANS

BACKGROUND AND SUMMARY

This invention relates to a dispensing apparatus for use with aerosol spray cans, and, more particularly, to a dispensing apparatus for intermittently spraying the contents of the cans.

The invention finds particular utility in those environments in which it is desired to dispense the contents of an aerosol can in response to movement of one member with respect to another member. For example, a two-part mold generally includes a stationary mold part and a movable mold part, and the mold is closed and opened by moving the movable part against and away from the stationary part. In the molding of many articles it is desirable to spray the surfaces of the mold cavity with a releasing agent to facilitate removal of the molded article when the mold opens.

The dispensing apparatus formed in accordance with the invention automatically sprays releasing agent into the mold cavity just before the mold closes. In some situations it is not necessary to spray the releasing agent during every cycle of the mold, and the dispensing apparatus is adjustable so that the releasing agent is not sprayed unnecessarily when it is not needed. The apparatus is adaptable for use with a wide variety of molding machines, and a special manifold, tubing and nozzle assembly permits the releasing agent to be sprayed at remote locations of the mold.

DESCRIPTION OF THE DRAWING

The invention will be explained in conjunction with illustrative embodiments shown in the accompanying drawing, in which —

DESCRIPTION OF SPECIFIC EMBODIMENTS

The invention has particular utility in spraying a releasing agent into a mold cavity during the closing cycle of the mold, and the invention will be explained in conjunction with such an application. However, it will be understood that the dispensing apparatus can be used for other purposes.

Figures 1, 2:
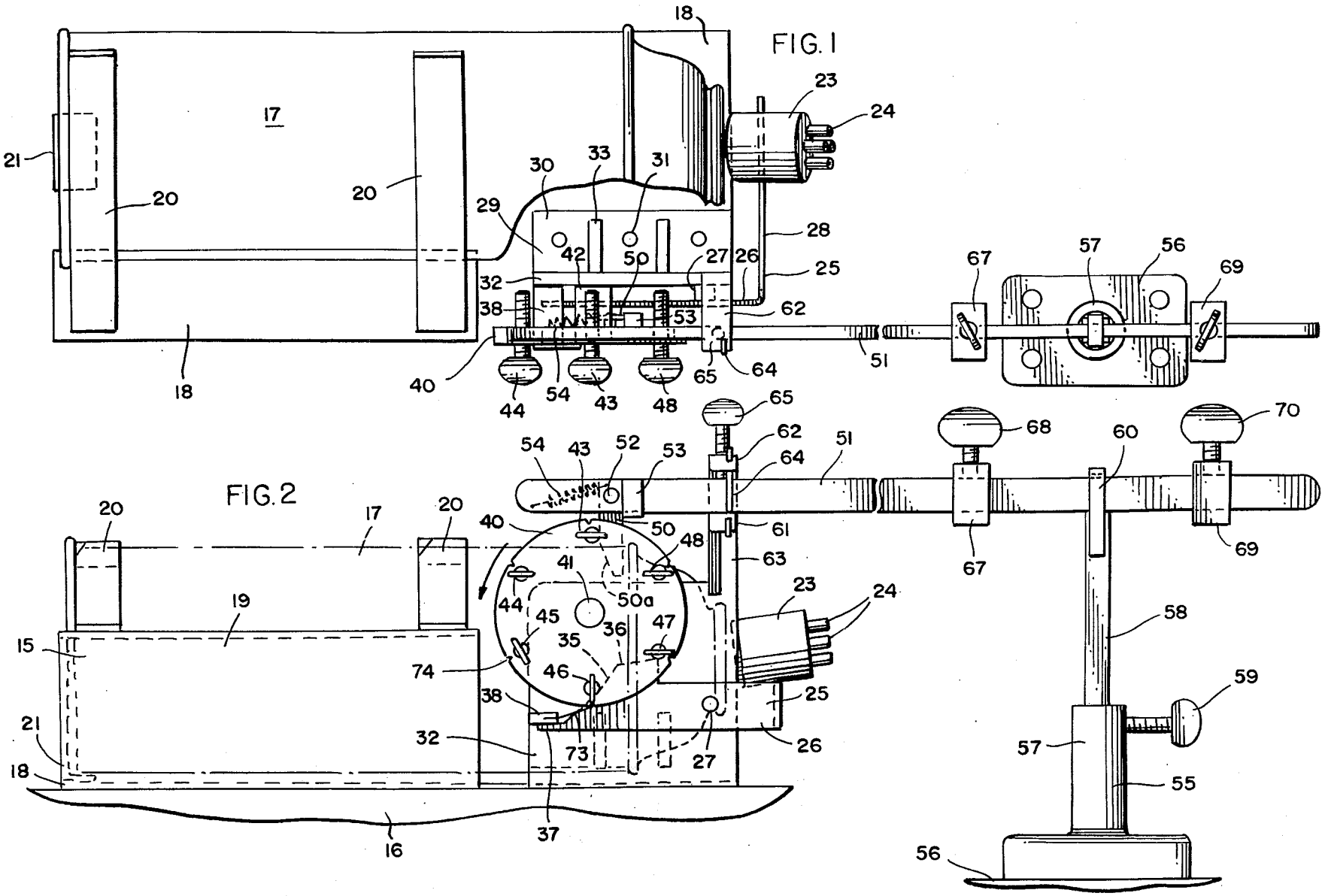
FIG. 1 is a top plan view of a dispensing apparatus formed in accordance with the invention.
FIG. 2 is an elevational view of the dispensing apparatus of FIG. 1.

Referring first to FIGS. 1 and 2, an aerosol can mounting bracket 15 is mounted on a stationary part 16 of a conventional two-part mold and is adapted for holding a conventional aerosol spray can 17. The mounting bracket 15 includes a base plate 18 attached to the mold part 16, a side wall 19 which extends upwardly from the base plate, and a pair of curved tempered steel straps 20 which are secured to the top of the wall 19 and which resiliently force the aerosol can against the base plate. An angle bracket 21 is secured to the rear of the mounting plate to engage the bottom rim of the can and to locate the can with respect to the valve-actuating mechanism.

The aerosol can is conventional and includes a valve which is operated by a valve stem which extends coaxial with the axis of the can. The valve is of the type which is open when the valve stem is tilted or pivoted away from the can axis. A generally cylindrical manifold 23 is mounted on the valve stem and includes a plurality of distribution tubes 24 which will be explained in detail hereinafter. The manifold and valve stem are shown in a slightly pivoted position in FIG. 2 in which the valve stem is not pivoted sufficiently from the can axis to open the valve, and in a position in FIG. 3 in which the manifold and valve stem are pivoted sufficiently to open the can valve to release the contents of the can into the manifold.

The manifold and valve stem are pivoted by an L-shaped actuator lever 25. The actuator lever includes a mounting leg 26 which is pivotally supported by a pin 27 and a leg 28 which extends below the manifold. The pivot pin 27 is supported by an L-shaped actuator support bracket 29 which includes a flat base 30 secured to the base plate 18 by screws 31 and a vertically extending wall 32 from which the pin extends. A pair of reinforcing ribs 33 strengthen the support bracket at the juncture of the base 30 and wall 32.

The leg 26 of the actuator lever includes first and second camming surfaces 35 and 36 which form an obtuse included angle. The rear end of the leg 26 terminates in a finger portion 37 which extends below and is engageable with a projection 38 which extends outwardly from the wall 32 of the support bracket. Engagement of the finger 37 with the projection 38 limits clockwise movement of the actuator lever beyond the position illustrated in FIG. 2.

A drive wheel 40 is rotatably mounted by a pin 41 which is inserted into a bushing 42 which extends outwardly from the side wall 32 of the support bracket. Six thumbscrews 43–48 are threadedly engaged with threaded openings in the drive wheel and extend laterally inwardly toward the support bracket parallel to the axis of rotation of the wheel. The thumbscrews act as abutment pins for rotating the drive wheel and pivoting the actuator lever as will be explained hereinafter.

The thumbscrews or pins are engageable by a pawl 50 which extends downwardly from an elongated drive arm 51 and is pivotally mounted thereon by a pivot pin 52. The pawl is prevented from counterclockwise rotation beyond the position illustrated in FIG. 2 by a stop finger 53 which is mounted on the drive arm and which extends inwardly toward the support bracket. The pawl remains free to rotate in the clockwise direction. When the dispensing apparatus is positioned so that the drive arm 51 extends horizontally as illustrated in FIG. 2, the weight of the pawl will normally maintain the pawl in the vertical position illustrated. However, a spring 54 which extends between the upper end of the pawl and the drive arm insures that the pawl will normally assume the position illustrated even when the dispensing apparatus is mounted in a position in which the drive arm does not extend horizontally.

The drive arm 51 is slidably supported by a support stand 55 which is mounted on the movable part 56 of the mold. The support stand includes a cylindrical rod support 57 and a rod 58 which is adjustably secured within the rod support by a thumbscrew 59. The drive arm is free to slide horizontally over the top of the support rod 58, and the drive arm is retained on the support rod by a U-shaped retaining bracket 60 which is secured to the rod. The rearward portion of the drive arm extends between a pair of vertically spaced projections 61 and 62 which extend laterally outwardly from an upwardly extending extension 63 of the side wall 32 of the support bracket. The drive arm is slidably supported by the bottom projection 61 and is retained thereon by a pin 64 which extends beyond the two projections. A thumbscrew 65 extends through the upper projection 62 and is adjustable to limit the amount of vertical movement of the drive arm relative to the bottom projection 61 as desired.

A drive collar 67 is slidably mounted on the drive arm 51 and can be secured to the drive arm at any desired point therealong between the support rod 58 and the support bracket for the aerosol can by a thumbscrew 68. A return collar 69 is similarly mounted on the drive arm on the other side of the support rod, and the location of the return collar can be fixed by a thumbscrew 70.

The movable mold part 56 and the support rod 58 are illustrated in FIG. 2 between the fully opened and fully closed positions of the two mold parts. As the mold parts close, the mold part 56 and support rod 58 move to the left as viewed in FIG. 2, and the support rod 58 slides relative to the drive arm 51 until the support rod engages the drive collar 67. At that time continued leftward movement of the support rod also moves the drive arm 51 to the left. The pawl 50 is in engagement with the abutment pin 43 positioned at 12 o'clock, and as the drive arm and the pawl are moved to the left, the pawl rotates the drive wheel 40 counterclockwise. The drive wheel is rotated by the pawl until the pin 43 rotates sufficiently to bring the pin below the bottom of the pawl, and further leftward movement of the pawl will not cause further rotation of the drive wheel.

As the drive wheel begins to rotate, the pin 46 at 6 o'clock engages the camming surface 35 of the actuator lever and forces the actuator lever to pivot counterclockwise. Counterclockwise rotation of the actuator lever causes the manifold 23 and the valve stem to be tilted further from the axis of the aerosol can to open the can valve and release the contents of the can.

The two camming surfaces 35 and 36 of the actuator lever have different slopes, i.e., each camming surface forms a different angle with a radius extending from the pivot point 27. The steeper slope of the camming surface 35 is designed to pivot the actuator lever quickly at the beginning of rotation of the cam wheel to open the can valve almost as soon as the drive wheel begins rotating. The second actuating surface 36 is designed to hold the actuator lever in a substantially constant position, illustrated in FIG. 3, in which the can valve is maintained open for as long as the pin remains in engagement with the camming surface.

Since the direction in which the pawl exerts a rotating force on the pin 43 changes as the drive wheel is rotated, the lower end of the pawl is provided with an angled edge 50*a* which compensates for the change in direction of the force by maintaining the driving edge of the pawl substantially perpendicular to a tangent to the arc along which the pin travels.

Figure 3:
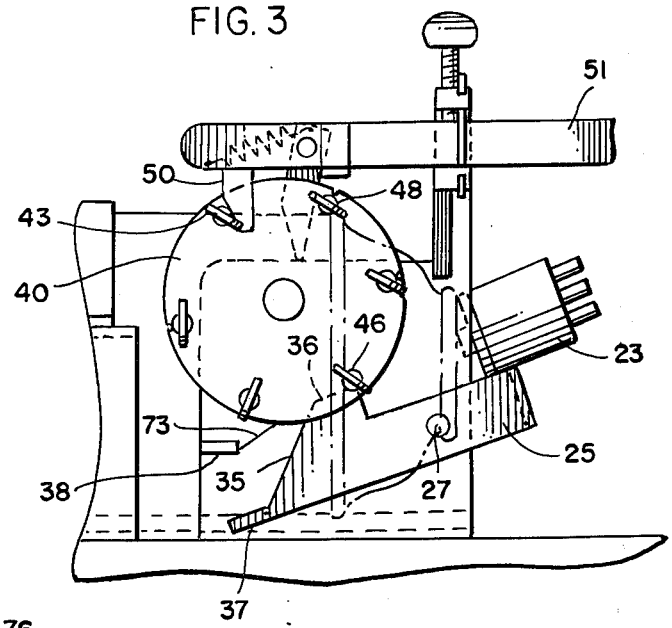
FIG. 3 is a fragmentary view of a portion of the dispensing apparatus in a position in which the contents of the aerosol can are being sprayed.

The drive wheel 40 is illustrated in FIG. 3 in a position in which the pin 46 is just about ready to clear the camming surface 36 of the actuator lever. As the pin 46 continues to rotate beyond the end of the camming surface, the actuator lever will be allowed to return to its original position under the influence of the force exerted by the closure spring of the can valve which biases the valve to a closed position. Shortly after the pin 46 passes beyond the end of the camming surface 36, the lower edge of the pawl will clear the pin 43, and rotation of the wheel will be discontinued even if the pawl continues to move to the left.

After the molding operation, the movable mold part 56 is moved away from the stationary part 16 so that the molded article can be ejected. As the movable mold part and the support rod 58 move to the right as viewed in FIG. 2, the support rod will slide along the drive arm 51 until it engages the return collar 69. Thereafter, continued movement of the support rod will pull the drive arm along with it. As the pawl engages the pin 48, which will have been rotated to about the 12 o'clock position, the pawl will pivot clockwise and pass over the pin without rotating the wheel.

In order to insure that the drive wheel 40 does not continue to rotate counterclockwise after the pawl becomes disengaged from the pin during closing of the mold, a strip of spring steel 73 is mounted on the projection 38 below the wheel. The strip 73 is resiliently biased against the periphery of the wheel and provides a frictional force resisting rotation of the wheel to provide smoother action. Further, the periphery of the wheel is provided with a notch 74 radially outwardly of each of the pins 43–48, and engagement of the spring with a groove stops the wheel in the position illustrated in FIG. 2, in which one of the pins is located at 12 o'clock and another pin is located at 6 o'clock.

As can be seen from FIG. 1, the pawl 50 is located laterally outwardly of the leg 26 of the actuator lever. If it is desired to eliminate the spraying operation during one or more mold closing cycles, one or more of the pins 43–48 can be unscrewed or backed off sufficiently so that those pins will not engage the camming surfaces of the actuator lever during rotation of the wheel. However, the pins will still be engageable by the pawl, and the wheel will be intermittently rotated during every closing cycle of the mold.

In the particular embodiment illustrated, the drive wheel includes six pins, and the pins can be adjusted to provide a total of eight spraying combinations as shown in the following table.

| SPRAYING COMBINATIONS | | | |
|---|---|---|---|
| SPRAY | SKIP | SCREWS IN | SCREWS OUT |
| Every cycle | None | 6 | 0 |
| Every second cycle | Every second cycle | 3 | 3 |
| Every third cycle | 2 cycles | 4 | 2 |
| 5 Times during each rotation of the drive wheel | 1 Time during each rotation of the drive wheel | 5 | 1 |
| 4 Times during each rotation of the drive wheel | 2 Times during each rotation of the drive wheel | 4 | 2 |
| 3 Times during each rotation of the drive wheel | 3 Times during each rotation of the drive wheel | 3 | 3 |
| 2 Times during each rotation of the drive wheel | 4 Times during each rotation of the drive wheel | 2 | 4 |
| 1 Time during each rotation of the drive wheel | 5 Times during each rotation of the drive wheel | 1 | 5 |

For example, if it is desired to spray the mold every other cycle, three equally spaced thumbscrews are left in the original position illustrated in FIG. 1 and three of the thumbscrews are backed off so that they will not engage the actuator lever. The term "Screws In" as used in the foregoing table refers to the original position of the thumbscrew illustrated in FIG. 1 in which the thumbscrew is engageable by both the pawl and the actuator lever, and the term "Screws Out" refers to the backed-off position of the screw in which it is engageable only with the pawl.

The adjustability of the support rod 58 permits the drive arm to be properly aligned with the actuating mechanism for the aerosol can. The thumbscrew 65 which is engaged with the guide 62 for the drive arm also can be used to accommodate some vertical misalignment. If the thumbscrew is backed off, the drive arm is permitted to move up slightly. The thumbscrew 65 also permits some "swing clearance" for the drive arm if a bell crank or similar mechanism is used to convert rotating motion from a rotary drive source into reciprocating motion of the drive arm.

The drive collar 67 can be located at any desired point along the drive arm so that the contents of the can are sprayed at the desired time during the mold closing cycle. If it is desired to spray the mold cavity shortly after the mold closing cycle begins, the drive collar is positioned adjacent the support rod 58 when the mold is in the fully opened position. The support rod 58 will engage the drive collar shortly after the mold begins to close, and the pawl 50 will rotate the drive wheel 40 about 60 degrees to cause a shot of mold releasing agent to be sprayed into the cavity. The pawl will continue to move to the left after it clears the thumbscrew and will not return to the right until the support rod 58 engages the return collar 69 during the opening cycle of the mold.

Figure 4:
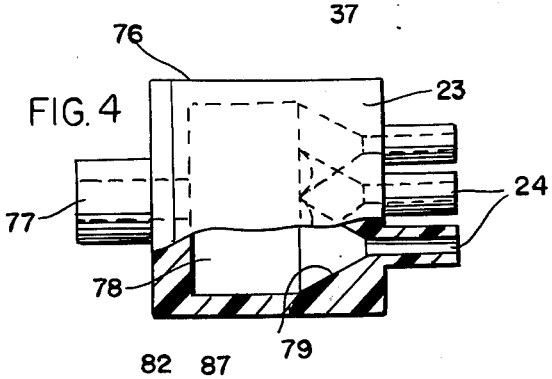
FIG. 4 is an enlarged side view of the manifold for the aerosol can.
Figure 5:
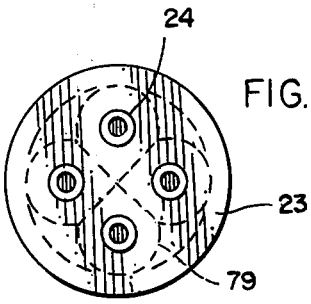
FIG. 5 is a front view of the manifold.

The manifold 23 which is mounted on the valve stem of the aerosol can replaces conventional aerosol can nozzles. The manifold equalizes the pressure of the sprayed material and distributes the material to remote locations of the mold. Referring to FIGS. 4 and 5, the manifold includes a generally cylindrical body 76 from which the distribution tubes 24 extend and a mounting tube 77 which fits snugly over the valve stem of the aerosol can. The body is provided with a central chamber 78 into which the contents of the can flow when the can valve is open, and each of the outlet tubes 24 of the manifold is supplied by a generally cone-shaped or funnel-shaped entry port 79.

Figure 6:
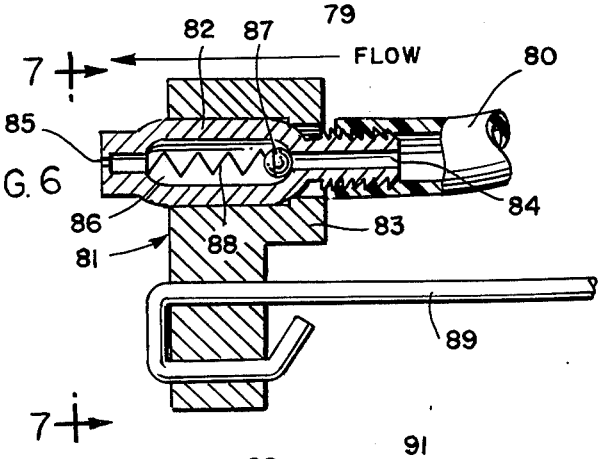
FIG. 6 is a sectional view of a check valve and nozzle assembly for use with the dispensing apparatus.
Figure 7:
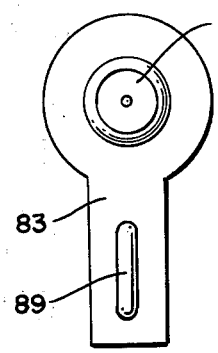
FIG. 7 is an end view of the check valve and nozzle assembly taken along the line 7—7 of FIG. 6.

A flexible tube 80 (FIG. 6) is connected to each of the outlet tubes 24 for directing the contents of the can to the location at which it is to be sprayed. In FIG. 6 the tube 80 is connected to a check valve-nozzle assembly 81 which includes a nozzle body 82 retained within a sleeve 83. The nozzle body includes a barbed connecting tube 84 over which the tube 80 is inserted and a nozzle or spraying orifice 85 which sprays the pressurized material which is supplied by the tube 80. The nozzle body 82 is provided with an enlarged central chamber 86 in which a ball 87 is mounted and resiliently biased against the opening of the connecting tube 84 by a spring 88. The ball 87 acts as a check valve, and the pressure at which the check valve-nozzle assembly will operate to spray material can be varied by changing the spring 88.

The body 82 is advantageously formed from two molded plastic body halves which are held together by the sleeve 83. When it is desired to change the spring 88, the body is merely removed from the sleeve so that the halves can be separated. A flexible wire 89 is attached to the sleeve for supporting the nozzle. The wire can be bent to direct the spray as desired.

Figure 8:
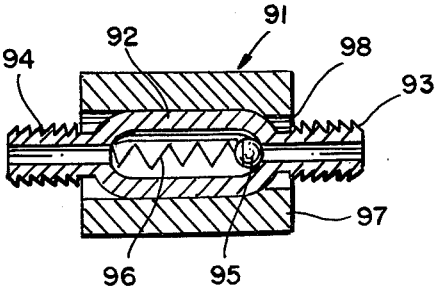
FIG. 8 is a sectional view of a check valve for use with the dispensing apparatus.
Figure 9:
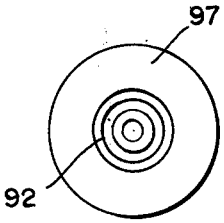
FIG. 9 is an end view of the check valve of FIG. 8.

FIGS. 8 and 9 illustrate a modified check valve assembly 91 which does not include a spraying orifice. The check valve assembly includes a body 92 which includes a pair of barbed tubular connectors 93 and 94, and a ball 95 is resiliently pressed against the port of one of the connectors by spring 96. The body is formed from two molded plastic halves which are held together by a sleeve 97.

A pressure-tight connection between the tubing and the inlet connector 93 is obtained by providing the opening 98 in the sleeve with a diameter that is larger than the outside diameter of the connector by an amount which corresponds to twice the thickness of the tubing. When the tubing is pushed over the barbs of the connector and into the sleeve, the sleeve will hold the tubing against the connector.

Figure 10:
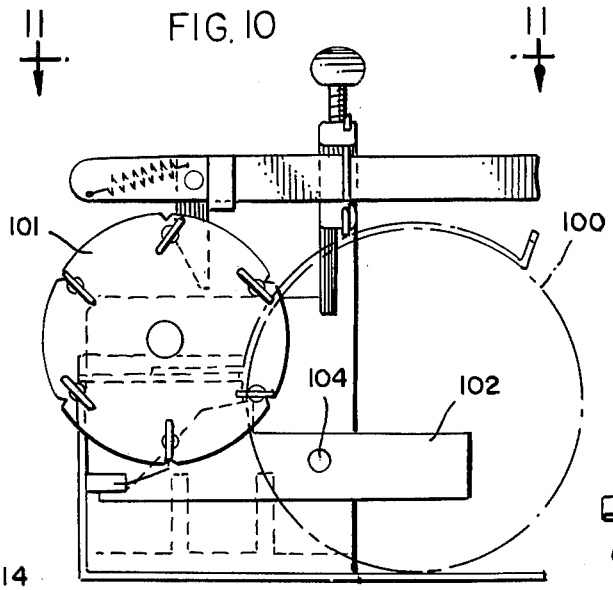
FIG. 10 is a fragmentary elevational view of a modified dispensing apparatus in which the aerosol can extends parallel to the axis of rotation of the drive wheel.
Figure 11:
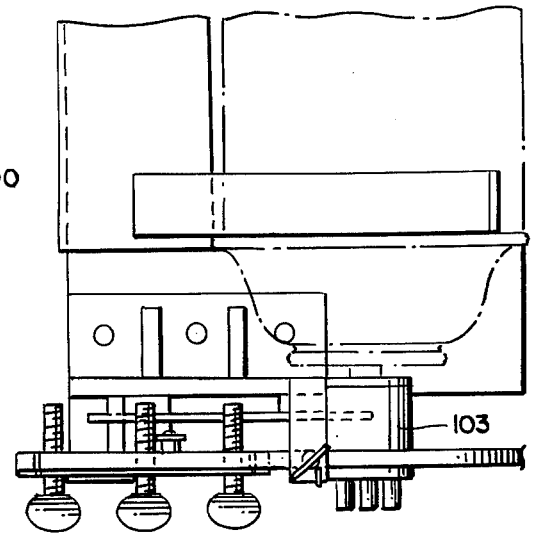
FIG. 11 is a fragmentary top plan view taken along the line 11—11 of FIG. 10.

A modified dispensing apparatus is illustrated in FIGS. 10 and 11. The dispensing apparatus is identical to the apparatus illustrated in FIGS. 1 and 2 except that the aerosol can 100 is mounted so that the axis thereof extends parallel to the axis of rotation of the drive wheel 101 and the actuator lever 102 is not L-shaped. Since the manifold 103 of the aerosol can extends parallel to the pivot pin 104 which mounts the actuator lever, the actuator lever need not be provided with the leg 28 which is shown in FIG. 1 for engaging the manifold. As the actuator lever is pivoted counterclockwise by the pins on the drive wheel, the upward movement of the right half of the lever will raise the manifold and open the can valve.

Figure 13:
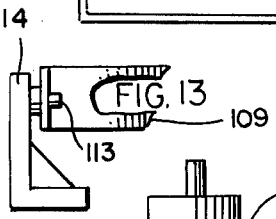
FIG. 13 is a fragmentary view of a portion of the dispensing apparatus taken along the line 13—13 of FIG. 12.
Figure 12:
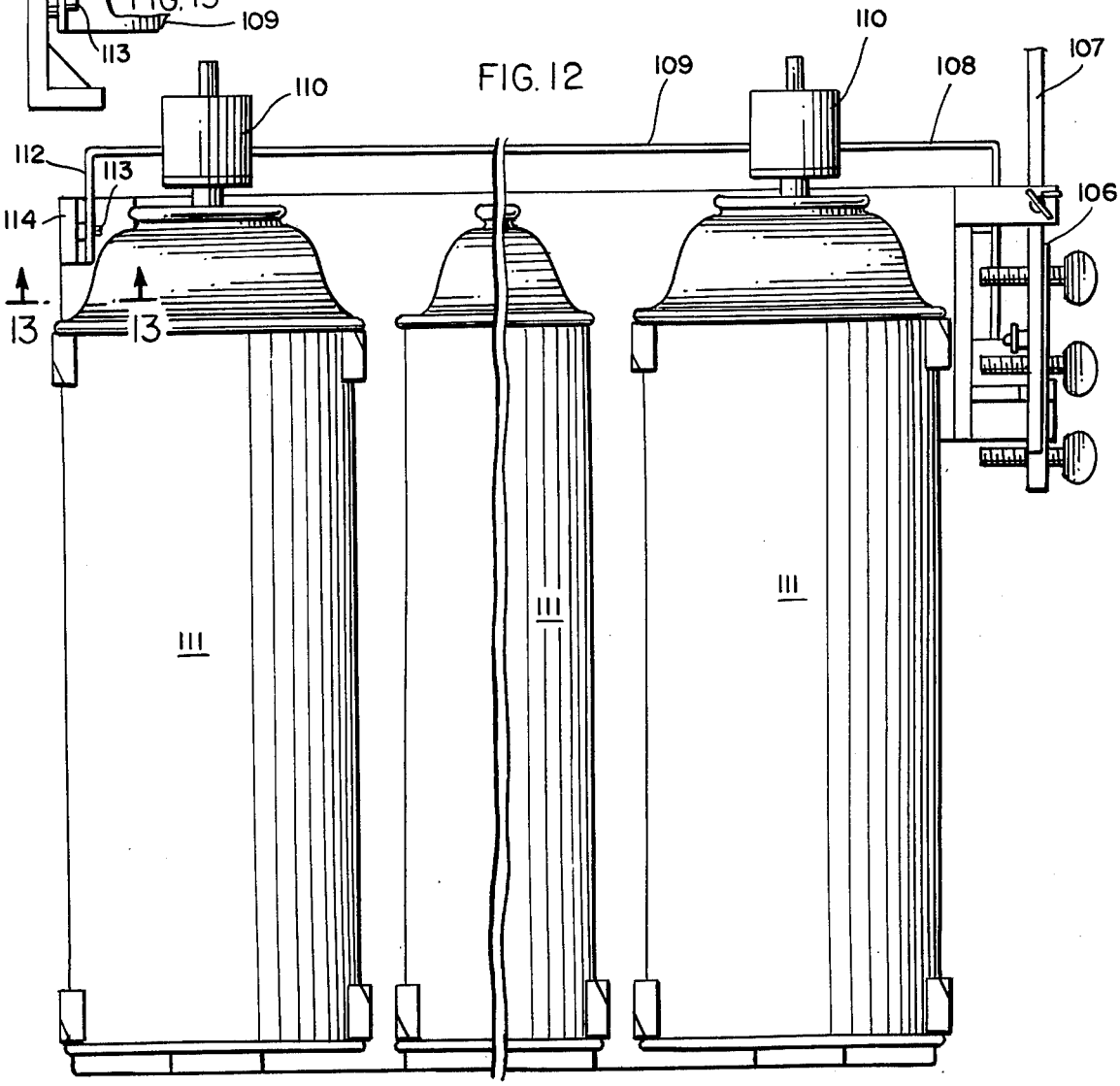
FIG. 12 is still another embodiment of the dispensing apparatus which may be used to spray the contents of a plurality of cans.

FIGS. 12 and 13 illustrate still another modification of the dispensing apparatus which permits a plurality of cans to be operated at the same time. The dispensing apparatus includes a drive wheel 106 which is identical to the drive wheel 40 previously described and a drive arm 107 which is identical to the drive arm 51. Rotation of the drive wheel 106 pivots an actuator lever 108 which is similar to the actuator lever 25 illustrated in FIGS. 1 and 2 except that the lever includes an elongated leg 109 which extends parallel to the pivoting axis of the lever below the manifolds 110 of the aerosol cans 111. The opposite end of the leg 109 merges with a support leg 112 which is pivotally supported by a pin 113 mounted on a support bracket 114.

While in the foregoing specification a detailed description of specific embodiments of the invention was set forth for the purpose of illustration, it is to be understood that many of the details hereingiven may be varied considerably by those skilled in the art without departing from the spirit and scope of the invention.

I claim:

1. A dispensing apparatus for intermittently releasing the contents of a valve-equipped aerosol can comprising a mounting frame, an actuator pivotally mounted on the frame and engageable with the valve of the aerosol can, the actuator being movable between a valve-closed position in which the valve of the aerosol can is closed and a valve-opened position in which the valve of the aerosol can is opened, an actuator drive member rotatably mounted on the frame and including a plurality of pins which extend parallel to the axis of rotation of the drive member, each pin being movable in said parallel direction between a first position in which it is engageable with the actuator as the drive member rotates for pivoting the actuator from the valve-closed position to the valve-opened position and a second position in which it is not engageable with the actuator whereby only selected ones of the pins will engage the actuator during one complete rotation of the drive member, and means engageable with the drive member for intermittently rotating the drive member whereby the valve of the aerosol can is intermittently opened.

2. The apparatus of claim 1 in which said means for rotating said drive member is engageable with said pins for rotating the drive member, the rotating means being engageable with each pin in both of said first and second positions of the pin.

3. The apparatus of claim 1 in which said means for rotating said drive member includes an arm mounted for reciprocation in a direction generally perpendicular to the axis of rotation of the drive member, a pawl pivotally mounted on the arm, and stop means on the arm engageable with the pawl for limiting pivoting movement of the pawl in one direction, the pawl engaging the stop means and one of said pins when the arm reciprocates in one direction whereby the drive member is rotated by the pawl, the pawl being pivotable when the arm reciprocates in the other direction whereby the drive member is not rotated, the pawl being engageable with each pin in both of said first and second positions of the pin.

4. The apparatus of claim 1 in which the actuator includes first and second camming surfaces, each camming surface forming a different angle with respect to a radius drawn from the pivot of the actuator to the camming surface, the angle formed by the first camming surface being such that the actuator is pivoted from the valve-closed position to the valve-opened position when one of said pins engages the first camming surface and the angle formed by the second camming surface being such that the actuator is maintained in the valve-opened position while one of said pins is in engagement with the second camming surface during rotation of the drive member.

5. A dispensing apparatus for intermittently releasing the contents of a valve-equipped aerosol can comprising a mounting frame, an actuator pivotally mounted on the frame and engageable with the valve of the aerosol can, the actuator being movable between a valve-closed position in which the valve of the aerosol can is closed and a valve-opened position in which the valve of the aerosol can is opened, an actuator drive member rotatably mounted on the frame and including a plurality of abutment means on the drive member engageable with the actuator as the drive member rotates for pivoting the actuator from the valve-closed position to the valve-opened position, an arm mounted for reciprocation in a direction generally perpendicular to the axis of rotation of the drive member, a pawl pivotally mounted on the arm, and stop means on the arm engageable with the pawl for limiting pivoting movement of the pawl in one direction, the pawl engaging the stop means and one of said abutment means when the arm reciprocates in one direction whereby the drive member is rotated by the pawl, the pawl being pivotable when the arm reciprocates in the other direction whereby the drive member is not rotated whereby the valve of the aerosol can is intermittently opened.

6. An apparatus for dispensing a mold releasing agent from a valve-equipped aerosol can during the closing cycle of a mold having two parts movable relative to one another comprising a. a can-mounting bracket mounted on one of the mold parts for holding an aerosol can containing a mold releasing agent, b. an actuator-support frame mounted on said one mold part adjacent the can-mounting bracket, c. an actuator pivotally mounted on the support frame and engageable with the valve of the aerosol can, the actuator being movable between a valve-closed position in which the valve of the aerosol can is closed and a valve-opened position in which the valve of the aerosol can is opened, d. a drive wheel rotatably mounted on the support frame for rotation about an axis extending parallel to the pivoting axis of the actuator, e. a plurality of pins mounted on the drive wheel and extending parallel to the axis of rotation of the drive wheel, each pin being engageable with the actuator as the drive wheel rotates for pivoting the actuator from the valve-closed position to the valve-opened position, and f. means mounted on the other mold part engageable with one of the pins as said other mold part moves toward said one mold part for intermittently rotating the drive wheel.

7. The apparatus of claim 6 in which each of said pins is movable in a direction parallel to said axis of rotation of said drive wheel between a first position in which the pin is engageable with said actuator as said drive wheel rotates and a second position in which the pin is not engageable with the actuator whereby only selected ones of the pins will engage the actuator during one complete rotation of the drive wheel.

8. The apparatus of claim 7 in which the means for rotating said drive wheel is engageable with said pins for rotating the drive wheel, the rotating means being engageable with each pin in both the first and second positions of the pin.

9. The apparatus of claim 6 in which the means for rotating said drive wheel includes an arm, an arm support mounted on said other mold part, the arm being mounted on the arm support for sliding movement in a direction generally perpendicular to the axis of rotation of the drive wheel, a pair of abutments adjustably secured to the arm, the arm support being engageable with one of the abutments after limited sliding movement of the arm relative to the arm support when said other mold part moves toward said one mold part whereby further sliding movement of the arm relative to the arm support is prevented, the arm support being engageable with the other of the abutments after limited sliding movement of the arm relative to the arm support when said other mold part moves away from said one mold part whereby further sliding movement of the arm relative to the arm support is prevented.

10. The apparatus of claim 9 including a pawl pivotally mounted on said arm and stop means on the arm engageable with the pawl for limiting pivoting movement of the pawl in one direction, the pawl engaging the stop means and one of said pins when the arm reciprocates in one direction whereby said drive wheel is rotated by the pawl, the pawl being pivotable when the arm reciprocates in the other direction whereby the drive wheel is not rotated.

11. The apparatus of claim 6 in which said actuator includes first and second camming surfaces, each camming surface forming a different angle with respect to a radius drawn from the pivot of the actuator to the camming surface, the angle formed by the first camming surface being such that the actuator is pivoted from the valve-closed position to the valve-opened position when one of said pins engages the first camming surface and the angle formed by the second camming surface being such that the actuator is maintained in the valve-opened position when one of the pins is in engagement with the second camming surface during rotation of said drive wheel.

12. The apparatus of claim 6 in which said valve includes a manifold having a plurality of ports through which the mold releasing agent flows when the valve is opened, and a flexible tube connected to each port for conveying mold releasing agent to a desired location of the mold.

13. The apparatus of claim 12 including a spraying nozzle connected to each of said tubes for spraying mold releasing agent.

14. The apparatus of claim 13 in which said spraying nozzle includes a check valve.

* * * * *